US007532189B2

(12) United States Patent
Hirosawa

(10) Patent No.: US 7,532,189 B2
(45) Date of Patent: May 12, 2009

(54) LIQUID CRYSTAL DISPLAY CAPABLE OF MAKING FLICKER DIFFICULT TO BE OBSERVED AND REDUCING POWER CONSUMPTION

(75) Inventor: Koji Hirosawa, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 696 days.

(21) Appl. No.: 10/994,316

(22) Filed: Nov. 23, 2004

(65) Prior Publication Data

US 2005/0110734 A1 May 26, 2005

(30) Foreign Application Priority Data

Nov. 25, 2003 (JP) ..... 2003-393285

(51) Int. Cl.
*G09G 3/36* (2006.01)

(52) U.S. Cl. ..... 345/98; 345/100

(58) Field of Classification Search ..... 345/87–104, 345/204

See application file for complete search history.

(56) References Cited

U.S. PATENT DOCUMENTS 6,243,062 B1 * 6/2001 den Boer et al. ..... 345/91
6,590,552 B1 7/2003 Yokoyama et al.
7,042,433 B1 * 5/2006 Kubota et al. ..... 345/100
2002/0084969 A1 7/2002 Ozawa
2002/0084970 A1 7/2002 Ozawa

FOREIGN PATENT DOCUMENTS

EP 0 910 062 A2 4/1999
JP 11109926 A * 4/1999
JP 2000-081606 A 3/2000
JP 2003-150080 A 5/2003
WO WO 03/083815 A2 3/2003

OTHER PUBLICATIONS

Search Report issued on Apr. 8, 2006 in corresponding European Application No. 04257329.5-2205.

* cited by examiner

*Primary Examiner*—Amare Mengistu
*Assistant Examiner*—Yuk Chow
(74) *Attorney, Agent, or Firm*—McDermott Will & Emery LLP

(57) ABSTRACT

The present invention provides a display capable of making flicker difficult to be observed and of reducing power consumption. The display comprises first and second pixel portions including subsidiary capacitances having a first electrode which is connected to a pixel electrode and a second electrode; first and second subsidiary capacitance lines which are connected to the second electrodes of the subsidiary capacitances of the first and second pixel portions, respectively; and a signal providing circuit including a plurality of signal providing circuit portions which provide first and second signals to the first and second subsidiary capacitance lines, respectively.

19 Claims, 10 Drawing Sheets

LIQUID CRYSTAL DISPLAY CAPABLE OF MAKING FLICKER DIFFICULT TO BE OBSERVED AND REDUCING POWER CONSUMPTION

BACKGROUND OF THE INVENTION

Field of the Invention

The present invention relates to a display, and more particularly to a display including a pixel portion.

CROSS-REFERENCE TO RELATED APPLICATIONS

The priority application number JP2003-393285 upon which this patent application is based is hereby incorporated by reference.

Description of the Background Art

A liquid crystal display including a pixel portion having a liquid crystal is known in general as a display. In this conventional liquid crystal display, a liquid crystal layer of the pixel portion is interposed between a pixel electrode and common electrode. In the conventional liquid crystal display, controlling a voltage (video signal) applied between the both electrodes of the pixel portion varies the arrangement of liquid crystal molecules, thus, a display portion displays an image based on the video signal.

In the aforementioned liquid crystal display, if a direct-current voltage is applied to the liquid crystal of the pixel portion (pixel electrode) for a long time, image persistence, so-called image burn-in, occurs. Accordingly, when the liquid crystal display is driven, it is necessary to use a drive method that inverts a voltage supply source of the pixel electrode (pixel voltage supply source) relative to a voltage supply source of the common electrode at a prescribed period. There is a DC drive method that applies a direct-current voltage to the common electrode as one example of such a drive method for a liquid crystal display. A line inversion drive method that inverts the pixel voltage supply source relative to the voltage supply source of the common electrode to which a direct-current voltage is applied at every one horizontal period is known as this DC drive method. This is disclosed in "EKISHO DISPLAY KOGAKU NYUMON" (SUZUKI, Yasoji, The Nikkan Kogyo Shimbun, Ltd., 20 Nov. 1998, pp. 101-103), for example. In addition, one horizontal period is a period where writing of video signals to all the pixel portions arranged along one gate line is completed.

FIG. 14 is the waveform chart in the case where a liquid crystal display is driven by the conventional line inversion drive method. With reference to FIG. 14, in the case where a liquid crystal display is driven by the conventional line inversion drive method, the pixel voltage supply source (video signal) VIDEO is inverted relative to a voltage supply source of the common electrode COM at every one horizontal period. The pixel voltage supply source (video signal) VIDEO is varied for each of pixel portions A to F based on an image to be displayed.

However, in the case where a liquid crystal display is driven by the conventional line inversion drive method shown in FIG. 14, when the display is driven at a low frequency in order to reduce power consumption, there is a disadvantage that flicker tends to be observed. Specifically, in the case where the display is driven at a low frequency, since the period of holding the pixel voltage supply source is longer, this makes the variation of the pixel voltage supply source large. When the variation of the pixel voltage supply source becomes large, since luminance values of light passing through the pixel portions A to F are shifted from desired luminance values, flicker occurs. In the conventional line inversion drive method, since the aforementioned flicker occurs in a line shape, flicker tends to be observed.

Accordingly, a liquid crystal display which employs a dot inversion drive method that inverts the pixel voltage supply source (video signal) VIDEO relative to the voltage supply source of the common electrode COM for every pixel portion in the pixel portions A to F adjacent to each other is proposed.

FIG. 15 is the waveform chart in the case where a liquid crystal display is driven by the conventional dot inversion drive method. With reference to FIG. 15, in the case where a liquid crystal display is driven by the conventional dot inversion drive method, the pixel voltage supply source (video signal) VIDEO based on an image to be displayed is inverted relative to the voltage supply source of the common electrode COM for every pixel portion in the pixel portions A to F, dissimilarly to the conventional line inversion drive method shown in FIG. 14. In the case where a liquid crystal display is driven by the conventional dot inversion drive method as mentioned above, even if flicker occurs due to drive at a low frequency, such flicker does not appear in a line shape. As a result, flicker can be difficult to be observed.

However, in the conventional dot inversion drive method shown in FIG. 15, the pixel voltage supply source (video signal) VIDEO is inverted relative to the voltage supply source of the common electrode COM to which a direct-current voltage is applied, thus, it is necessary to provide a video signal that is double the voltage of a liquid crystal drive voltage. For example, in FIG. 15, when the liquid crystal drive voltage is V1, in order to provide the same liquid crystal drive voltage V1 to both previous and subsequent pixel portions whose pixel voltage supply sources (video signals) VIDEO are inverted relative to the voltage supply source of the common electrode COM, it is necessary to provide a video signal having a voltage V2 that is double the voltage of the liquid crystal drive voltage V1. Accordingly, even if driving a liquid crystal display at a low frequency is aimed at reduction of power consumption, there is a problem that reduction of power consumption is limited.

SUMMARY OF THE INVENTION

The present invention is aimed at solving the above problems, and it is one object of the present invention to provide a display capable of making flicker difficult to be observed and of reducing power consumption.

To achieve the above object, a display according to one aspect of the present invention comprises a plurality of drain and gate lines which are arranged so as to intersect each other; first and second pixel portions, each of which includes subsidiary capacitances having a first electrode which is connected to a pixel electrode and a second electrode; first and second subsidiary capacitance lines which are connected to the second electrodes of the subsidiary capacitances of the first and second pixel portions, respectively; and a signal providing circuit including a plurality of signal providing circuit portions which provide a first signal with a first voltage supply source and a second signal with a second voltage supply source to the first subsidiary capacitance line of said first pixel portion and the second subsidiary capacitance line of said second pixel portion, respectively.

In the display according to this aspect of the present invention, the above signal providing circuit is provided. Accordingly, in the case where the first and second voltage supply sources are H and L levels, and the first and second signals are provided to the first and second subsidiary capacitance lines of the first and second pixel portions, respectively, the first signal of H level is provided to the second electrode of the subsidiary capacitance of the first pixel portion through the first subsidiary capacitance line. Thus, the voltage supply source of the subsidiary capacitance of the first pixel portion can go up to H level. In addition, the second signal of L level is provided to the second electrode of the subsidiary capacitance of the second pixel portion through the second subsidiary capacitance line, thus, the voltage supply source of the subsidiary capacitance of the second pixel portion can drop to L level. Therefore, after writing of video signal of H level to the first pixel portion is completed, when the first signal of H level is provided to the second electrode of the subsidiary capacitance of the first pixel portion, the voltage supply source of the pixel electrode of the first pixel portion can be higher than the state right after writing of video signal is completed. Therefore, after writing of video signal of L level to the second pixel portion is completed, when the second signal of L level is provided to the second electrode of the subsidiary capacitance of the second pixel portion, the pixel voltage supply source of the second pixel portion can be lower than the state right after writing of video signal is completed. Since the voltage of video signal is not necessary to be large, it is possible to easily keep increase of power consumption due to increase of the voltage of video signal in check. As a result, power consumption can be reduced. Furthermore, in the case where dot inversion drive, in which the pixel voltage supply source (video data) is inverted for each of pixel portions adjacent to each other relative to a voltage supply source of a common electrode, is used, arranging the first and second pixel portions adjacent to each other can easily achieve dot inversion drive. Moreover, in the case where block inversion drive, in which the pixel voltage supply source (video data) is inverted for every two or more of pixel portions relative to the voltage supply source of the common electrode, is used, one block includes only a plurality of first pixel portions, another block includes only a plurality of second pixel portions, and the one, and another blocks are arranged adjacent to each other. This can easily achieve block inversion drive. In dot or block inversion drive, flicker does not appear in a line shape, dissimilarly to line inversion drive that inverts the pixel voltage supply source (video data) for each of gate lines adjacent to each other relative to a voltage supply source of a common electrode, therefore, it is easy to make flicker difficult to be observed.

DESCRIPTION OF THE PREFERRED EMBODIMENTS

Embodiments of the present invention are now described with reference to the drawings.

First Embodiment

Figure 1:
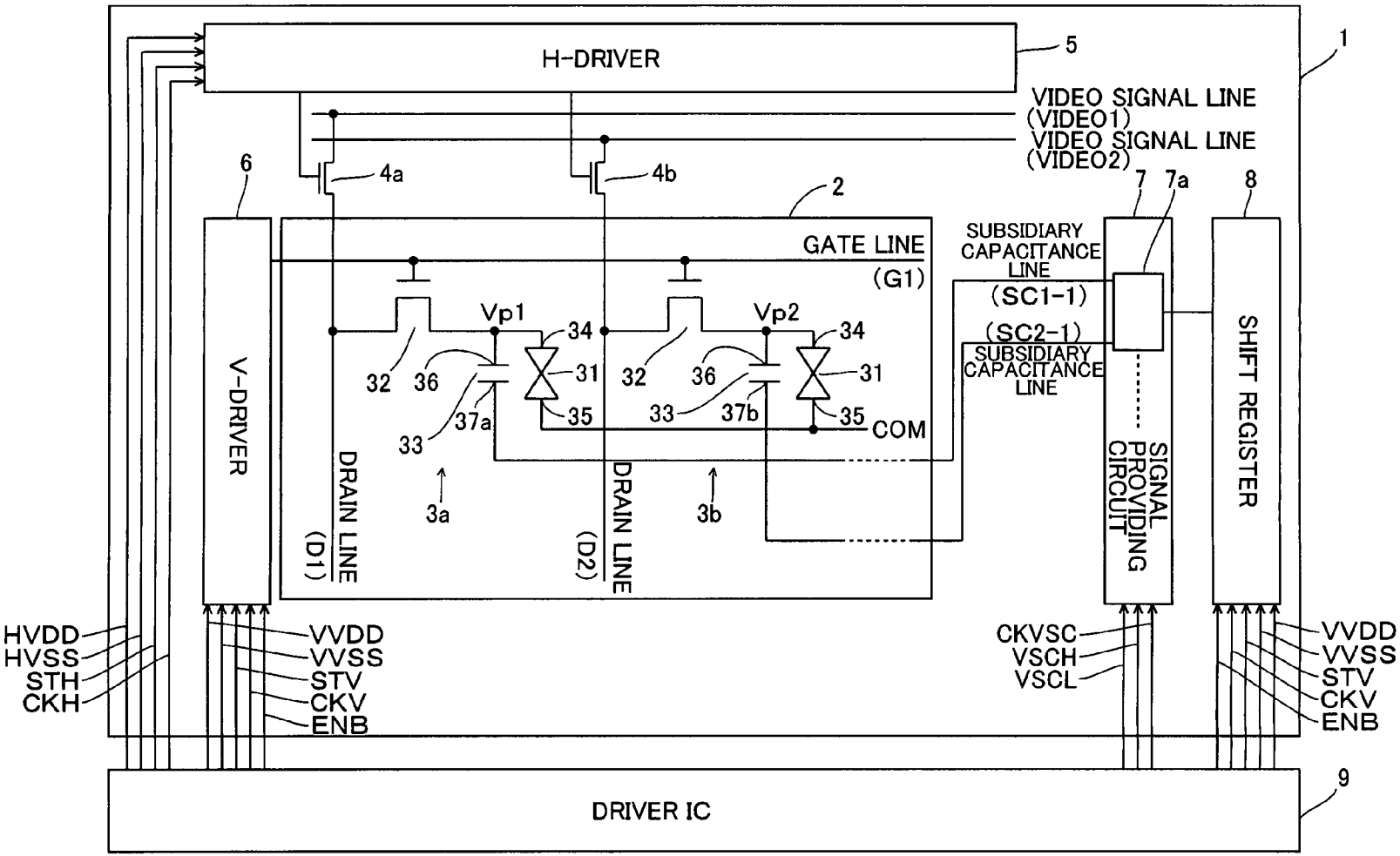
FIG. 1 is a plan view showing a liquid crystal display according to a first embodiment.

With reference to FIG. 1, in a first embodiment, a display portion 2 is provided on a circuit board 1. Pixel portions 3*a* and 3*b* are arranged in the display portion 2. In FIG. 1, one gate line G1 and two drain lines D1 and D2, which intersect the gate line G1, are shown, and only one of the pixel portions 3*a* and one of the pixel portions 3*b* arranged along the gate line G1 are shown, for ease of illustration. However, actually, a plurality of gate and drain lines are arranged so as to intersect each other, and the pixel portions 3*a* and the pixel portions 3*b* are arranged adjacent to each other in a matrix shape. The pixel portions 3*a* and 3*b* are examples of a "first pixel portion" and a "second pixel portion" in the present invention, respectively.

Each of the pixel portions 3*a* and 3*b* includes a liquid crystal layer 31, an n-channel transistor 32 and a subsidiary capacitance 33. The liquid crystal layer 31 of each of the pixel portions 3*a* and 3*b* is interposed between a pixel electrode 34 and a common counter electrode (common electrode) 35.

The drain of the n-channel transistor 32 of the pixel portion 3*a* is connected to the drain line D1. The drain of the n-channel transistor 32 of the pixel portion 3*b* is connected to the drain line D2. The sources of the pixel portions 3*a* and 3*b* are connected to the pixel electrodes 34, respectively.

One electrode 36 of the subsidiary capacitance 33 of each of the pixel portions 3*a* and 3*b* is connected to each pixel electrode 34. Another electrode 37*a* of the subsidiary capacitance 33 of the pixel portion 3*a* is connected to a subsidiary capacitance line SC1-1. Another electrode 37*b* of the subsidiary capacitance 33 of the pixel portion 3*b* is connected to a subsidiary capacitance line SC2-1. The electrode 36 is an example of a "first electrode" in the present invention. The electrodes 37*a* and 37*b* are examples of a "second electrode" in the present invention. The subsidiary capacitance line SC1-1 is an example of a "first subsidiary capacitance line" in the present invention. The subsidiary capacitance line SC2-1 is an example of a "second subsidiary capacitance line" in the present invention.

N-channel transistors (H switches) 4*a* and 4*b*, and an H-driver 5 for driving (scanning) the drain lines D1 and D2 and drain lines of a third stage and later (not shown) are provided on the circuit board 1. The n-channel transistor 4*a* corresponding to the pixel portion 3*a* (drain line D1) is connected to a video signal line VIDEO1. The n-channel transistor 4*b* corresponding to the pixel portion 3*b* (drain line D2) is connected to a video signal line VIDEO2. A V-driver 6 for driving (scanning) the gate line G1 of a first stage of and gate lines after a second stage and later (not shown in FIG. 1) is provided on the circuit board 1. The V-driver 6 is an example of a "gate line drive circuit" and "first shift register" in the present invention.

In the first embodiment, a signal providing circuit 7 and a shift register 8 are provided on the circuit board 1. Both the subsidiary capacitance line SC1-1 corresponding to the pixel portion 3*a* and the subsidiary capacitance line SC2-1 corresponding to the pixel portion 3*b* are connected to the signal providing circuit 7 (signal providing circuit portion 7*a*). The signal providing circuit 7 serves to alternately provide one of an H-level side signal VSCH and an L-level side signal VSCL to the subsidiary capacitance line SC1-1, and alternately provide the other of them to the subsidiary capacitance line SC2-1, for every one frame period. One frame period is a period where writing of signals to all the pixel portions 3*a* and 3*b*, which constitute the display portion 2, is completed. The shift register 8 serves to drive the signal providing circuit 7 so that the signals from the signal providing circuit 7 are sequentially provided to a pair of subsidiary capacitance lines SC1-1 and SC2-1 along the gate line G1 of the first stage thorough a pair of subsidiary capacitance lines along a gate line of the last stage (not shown). The shift register 8 is an example of a "second shift register" in the present invention.

A driver IC 9 is provided external of the circuit board 1. A higher voltage supply source HVDD, a lower voltage supply source HVSS, a start signal STH, and a clock signal CKH are provided from the driver IC 9 to the H-driver 5. A higher voltage supply source VVDD, a lower voltage supply source VVSS, a start signal STV, a clock signal CKV, and an enable signal ENB are provided from the driver IC 9 to the V-driver 6. A higher voltage supply source VSCH, a lower voltage supply source VSCL, and a clock signal CKVSC are provided from the driver IC 9 to the signal providing circuit 7. The same signals as the signals provided to the V-driver 6 are provided from the driver IC 9 to the shift register 8.

Figure 2:
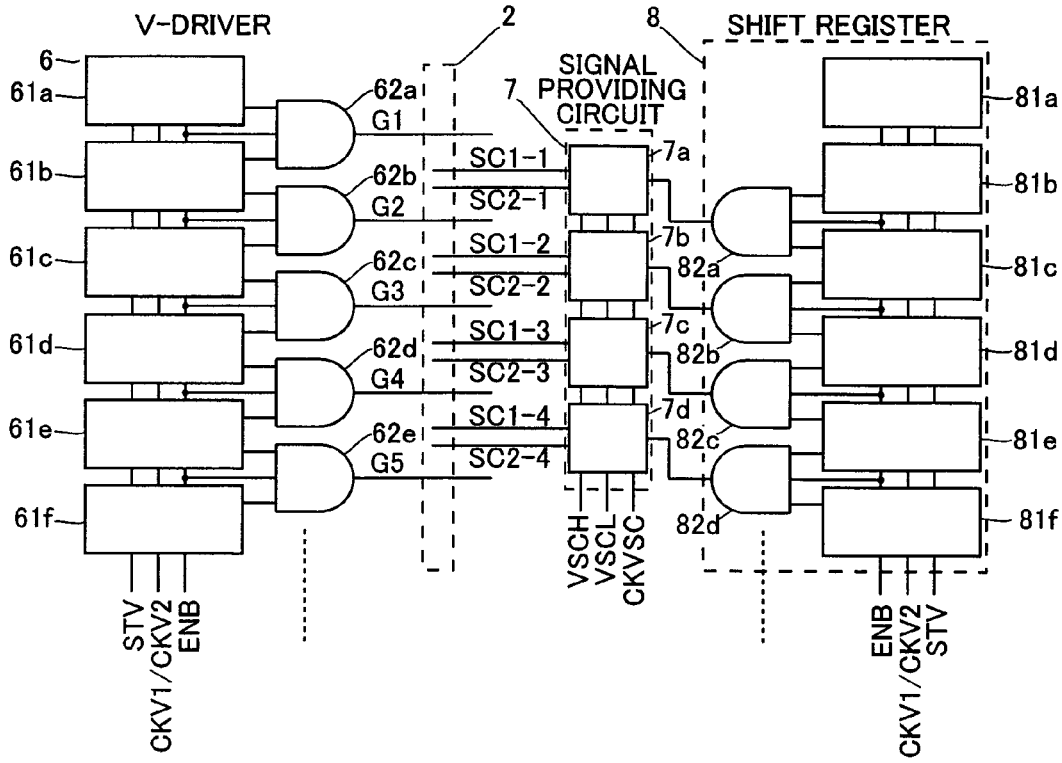
FIG. 2 is a block diagram showing the liquid crystal display according to the first embodiment shown in FIG. 1.

With reference to FIG. 2, the internal constitution of V-driver 6, signal providing circuit 7, and shift register 8 is now described. The V-driver 6 includes shift register circuit portions 61*a* to 61*f*. In addition, the V-driver 6 includes AND circuit portions 62*a* to 62*e*, each of which has three input terminals and one output terminal.

Output signals of the shift register circuit portions 61*a* and 61*b*, and the enable signal ENB are provided to the input terminals of the AND circuit portion 62*a*. Output signals of the shift register circuit portions 61*b* and 61*c*, and the enable signal ENB are provided to the input terminals of the AND circuit portion 62*b*. In the AND circuit portion 62*c* or later, output signals of the shift register circuit portions of two stages that are shifted one stage each are similarly provided thereto. Each of the AND circuit portions 62*a* to 62*e* provides a signal of H level only when the three input signals are all H levels, and provide a signal of L level when at least one of the three input signals is L level. The output terminals of the AND circuit portions 62*a* to 62*e* are connected to the gate lines G1 to G5, respectively. Although not illustrated, a level shifter circuit is connected between the AND circuit portion and the gate line.

The signal providing circuit 7 includes signal providing circuit portions 7*a* to 7*d*. The signal providing circuit portions 7*a* to 7*d* are provided so as to correspond to the gate lines G1 to G4, respectively. The signal providing circuit portion corresponding to the gate line G5 is not shown for ease of illustration.

Figure 3:
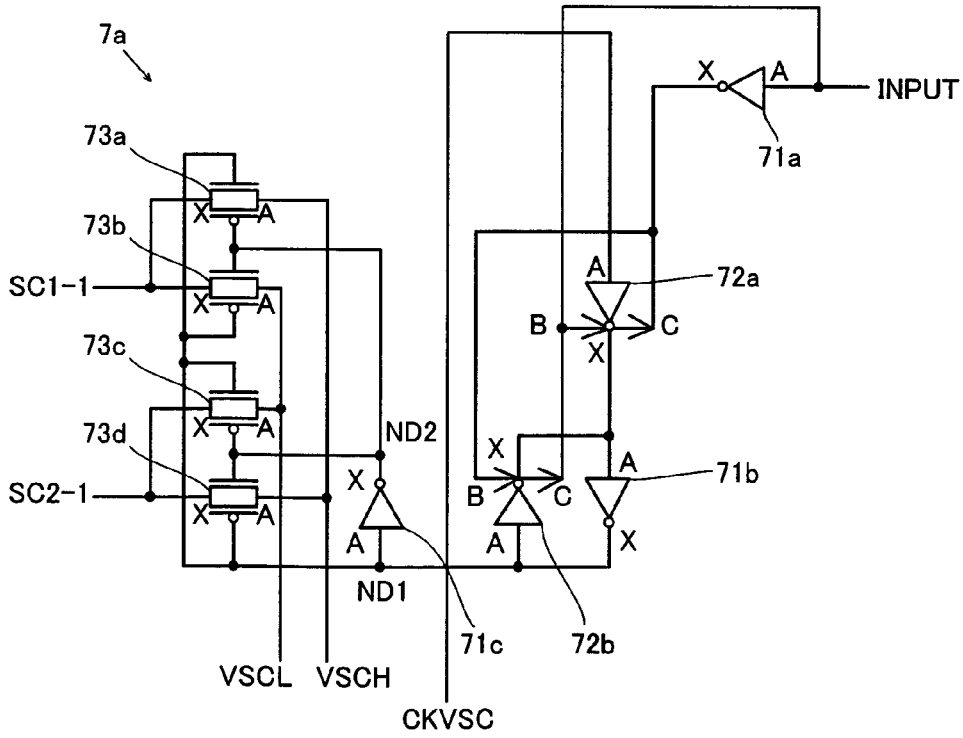
FIG. 3 is a circuit diagram showing a signal providing circuit portion of the liquid crystal display according to the first embodiment shown in FIGS. 1 and 2.

In the circuit constitution, specifically, the signal providing circuit portion 7*a* is constituted of inverters 71*a* to 71*c*, clocked inverters 72*a* and 72*b*, and switches 73*a* to 73*d*, as shown in FIG. 3. Each of switches 73*a* to 73*d* is constituted of an n-channel transistor and a p-channel transistor.

An output signal from the shift register 8 (see FIG. 2) is provided to an input terminal A of the inverter 71*a*. The output signal from the shift register 8 is also provided to an input terminal B of the clocked inverter 72*a*. An input terminal C of the clocked inverter 72*a* is connected to an output terminal X of the inverter 71*a*. The clock signal CKVSC is provided to an input terminal A of the clocked inverter 72*a*. An output terminal X of the clocked inverter 72*a* is connected to an input terminal A of the inverter 71*b*. An output terminal X of the inverter 71*b* is connected to a node ND1. An input terminal B of the clocked inverter 72*b* is connected to the output terminal X of the inverter 71*a*. The output signal from the shift register 8 is provided into an input terminal C of the clocked inverter 72*b*. An input terminal A of clocked inverter 72*b* is connected to the node ND1. An input terminal A of the inverter 71*c* is connected to the node ND1. An output terminal X of the inverter 71*c* is connected to the node ND2.

The higher voltage supply source VSCH and the lower voltage supply source VSCL are provided to the input terminals A of the switches 73*a* and 73*d*, and the input terminals A of the switches 73*b* and 73*c*, respectively. The output terminals X of the switches 73*a* and 73*b*, and the output terminals X of the switches 73*c* and 73*d* are connected to the subsidiary capacitance lines SC1-1 and SC2-1, respectively. The gates of the n-channel transistors of the switches 73*a* and 73*c* are connected to the node ND1. The gates of the p-channel transistors of the switches 73*a* and 73*c* are connected to the node ND2. The gates of the n-channel transistors of the switches 73*b* and 73*d* are connected to the node ND2. The gates of the p-channel transistors of the switches 73*b* and 73*d* are connected to the node ND1.

In addition, the signal providing circuit portions 7*b* to 7*d* shown in FIG. 2 have circuit constitution similar to the signal providing circuit portion 7*a* except the subsidiary capacitance lines connected thereto.

As shown in FIG. 2, the shift register 8 includes shift register circuit portions 81*a* to 81*f*. These shift register circuit portions 81*a* to 81*f* can have circuit constitution similar to the shift register circuit portions 61*a* to 61*f* of the V-driver 6, respectively. In addition, the shift register 8 includes AND circuit portions 82*a* to 82*d*, each of which has three input terminals and one output terminal.

Output signals of the shift register circuit portions 81*b* and 81*c*, and the enable signal ENB are provided to the input terminals of the AND circuit portion 82*a*. In the AND circuit portion 82*b* or later, output signals of the shift register circuit portions of two stages that are shifted one stage each are similarly provided thereto. The output terminals of the AND circuit portions 82*a* to 82*d* are connected to the signal providing circuit portions 7*a* to 7*d*, respectively. In addition, the shift register 8 is not provided with an AND circuit portion, to which output signals of the shift register circuit portions 81*a* and 81*b* are provided, dissimilarly to the V-driver 6. The reason is as follows. That is, the same start signal STV, clock signal CKV, and enable signal ENB as the V-driver 6 are provided to the shift register 8. Accordingly, in order to vary the voltage supply source of the subsidiary capacitances of first stage after writing of video signals to the pixel portions of first stage is completed, it is necessary to vary the voltage supply source of the subsidiary capacitances of first stage based on the signal of H level of AND circuit portion of second stage. For this reason, such an AND circuit portion of first stage, to which the output signal of the shift register circuit portions 81*a* and 81*b* are provided, is not necessary.

The operation of the liquid crystal display according to the first embodiment is now described with reference to FIGS. 1 to 6.

Figure 4:
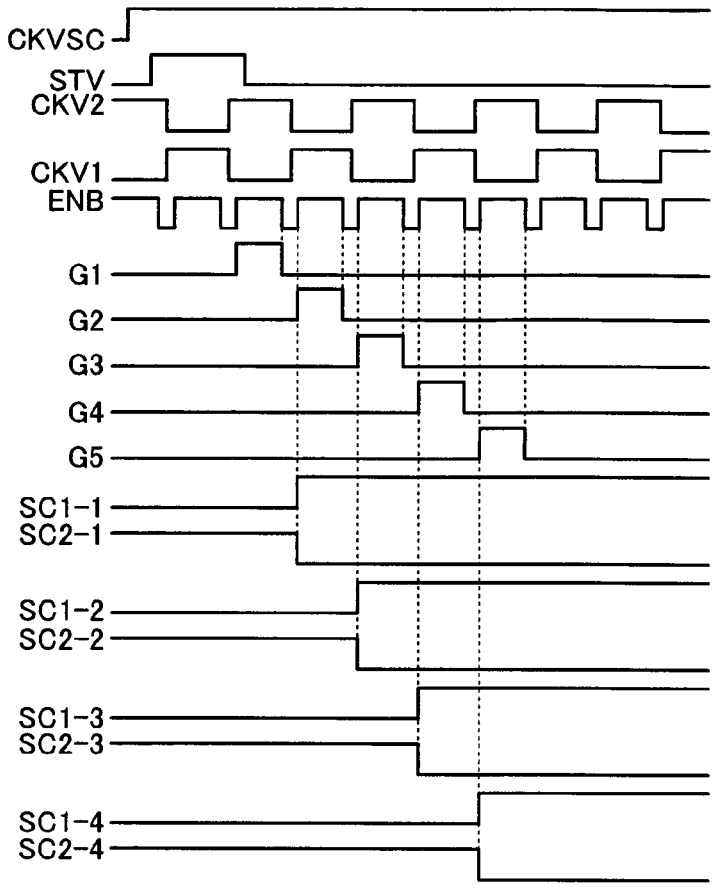
FIG. 4 is a timing chart for explanation of operation in a V-driver, the signal providing circuit and a shift register of the liquid crystal display according to the first embodiment shown in FIG. 2.

First, as shown in FIG. 4, the start signal STV of H level is provided to the V-driver 6 and shift register 8 shown in FIG. 2. When a clock signal CKV1 in V-driver 6 becomes H level, a signal of H level is provided from the shift register circuit portion 61*a* (see FIG. 2) to the AND circuit portion 62*a*. After that, when the clock signal CKV1 becomes L level, and the clock signal CKV2 becomes H level, signals of H level are provided from the shift register circuit portion 61*b* to the AND circuit portions 62*a* and 62*b*. Subsequently, the enable signal ENB becomes H level, thus, all of the three signals (the signals of the shift register circuit portions 61*a* and 61*b*, and the enable signal ENB) provided to the AND circuit portion 62*a* become H level. Accordingly, a signal of H level is provided from the AND circuit portion 62*a* to the gate line G1. After that, the enable signal ENB becomes L level, thus, a signal of L level is provided from the AND circuit portion 62*a* to the gate line G1, and the signal of L level is held at L level during one frame period. Then, the clock signal CKV2 becomes L level.

Next, when the clock signal CKV1 becomes H level again, signals of H level are provided from the shift register circuit portion 61*c* to the AND circuit portions 62*b* and 62*c*. Subsequently, when the enable signal ENB becomes H level again, all of the three signals (the signals of the shift register circuit portions 61*b* and 61*c*, and the enable signal ENB) provided to the AND circuit portion 62*b* become H level. Accordingly, a signal of H level is provided from the AND circuit portion 62*b* to the gate line G2. After that, when the enable signal ENB becomes L level, a signal of L level is provided from the AND circuit portion 62*b* to the gate line G2, and it is held at L level during one frame period. Then, the clock signal CKV1 becomes L level.

After that, signals of H level from the shift register circuit portions 61*d* to 61*f* are sequentially provided to the AND circuit portions 62*c* to 62*e* in synchronization with the clock signals CKV1 and CKV2 similarly to the aforementioned AND circuit portions 62*a* and 62*b*. Accordingly, signals of H level from the AND circuit portions 62*c* to 62*e* are sequentially provided to the gate lines G3 to G5 in synchronization with the enable signal ENB similarly to the aforementioned gate lines G1 and G2. Subsequently, signals of L level from the AND circuit portions 62*c* to 62*e* are sequentially provided to the gate lines G3 to G5 in synchronization with the enable signal ENB, and they are held at L level during one frame period. In addition, as shown in FIG. 4, since the gate lines G1 to G5 are forced to be L level while the enable signal ENB is L level, the periods of H level of gate lines adjacent to each other do not coincide with each other.

In the shift register 8 (AND circuit portions 82*a*-82*d*) (see FIG. 2), signals of H level from the shift register circuit portions 81*b* (81*a*) to 81*f* are also sequentially provided to the AND circuit portions 82*a* to 82*d* in synchronization with the clock signals CKV1 and CKV2 similarly the aforementioned AND circuit portions 62*a* to 62*e*. Thus, signals of H level are sequentially provided from the AND circuit portions 82*a* to 82*d* in synchronization with the enable signal ENB. Accordingly, signals of H level are sequentially provided from the shift register 8. In addition, signals of H level from the shift register 8 are sequentially provided with timing similar to providing signals of H level to the gate lines G2 to G5.

Signals of H level sequentially provided from the shift register 8 are sequentially provided to the signal providing circuit portions 7*a* to 7*d* of the signal providing circuit 7 (see FIG. 2).

In the signal providing circuit portion 7*a*, as shown in FIG. 3, when an input signal of H level is provided from the shift register 8, the clocked inverter 72*a* turns to ON state. In this case, the clock signal CKVSC of H level is provided to the input terminal A of the clocked inverter 72*a*, thus, a signal of L level is provided from the output terminal X of the clocked inverter 72*a*. This signal of L level is inverted into H level by the inverter 71*b*. Thus, the node ND1 becomes H level, and the node ND2 becomes L level by the inverter 71*c*. Accordingly, the switches 73*a* and 73*c* turn to ON state, and the switches 73*b* and 73*d* turn to OFF state. As a result, the signal VSCH of H-level side is provided to the subsidiary capacitance line SC1-1, and the signal VSCL of L-level side is provided to the subsidiary capacitance line SC2-1.

When the input signal from the shift register 8 becomes L level, the clocked inverter 72*a* turns to OFF state. However, since the clocked inverter 72*b* turns to ON state, a signal of L level is continuously provided to the input terminal A of the inverter 71*b*. As a result, since the nodes ND1 and ND2 are held at H level and L level, respectively, the signal VSCH of the H-level side and the signal VSCL of the L-level side are continuously provided to the subsidiary capacitance lines SC1-1 and SC2-1, respectively. In addition, the signal providing circuit portions 7*b* to 7*d* shown in FIG. 2 operate similarly to the signal providing circuit portion 7*a*.

Accordingly, the subsidiary capacitance lines SC1-1 to SC1-4 and the subsidiary capacitance lines SC2-1 to SC2-4 are sequentially provided with the signal VSCH of the H-level side and the signal VSCL of the L-level side from the signal providing circuit portions 7*a* to 7*d* with timing similar to providing signals of H level to the gate lines G2 to G5. The subsidiary capacitance lines SC1-2, SC1-3, and SC1-4 are examples of the "first subsidiary capacitance line" in the present invention. The subsidiary capacitance lines SC2-2, SC2-3, and SC2-4 are examples of the "second subsidiary capacitance line" in the present invention.

For example, the display portion 2 shown in FIG. 1 operates as follows. First, a video signal of H-level side is provided to the video signal line VIDEO1, and a video signal of the L-level side is provided to the video signal line VIDEO2. Then, signals of H level are sequentially provided from the H-driver 5 to the gates of the n-channel transistors 4*a* and 4*b*, thus, the n-channel transistors 4*a* and 4*b* sequentially turn to ON state. Accordingly, the video signal of H-level side is provided from the video signal line VIDEO1 to the drain line D1 of the pixel portion 3*a*, and the video signal of L-level side is provided from the video signal line VIDEO2 to the drain line D2 of the pixel portion 3*b*. Subsequently, as described above, a signal of H level is provided to the gate line G1.

Figure 5:
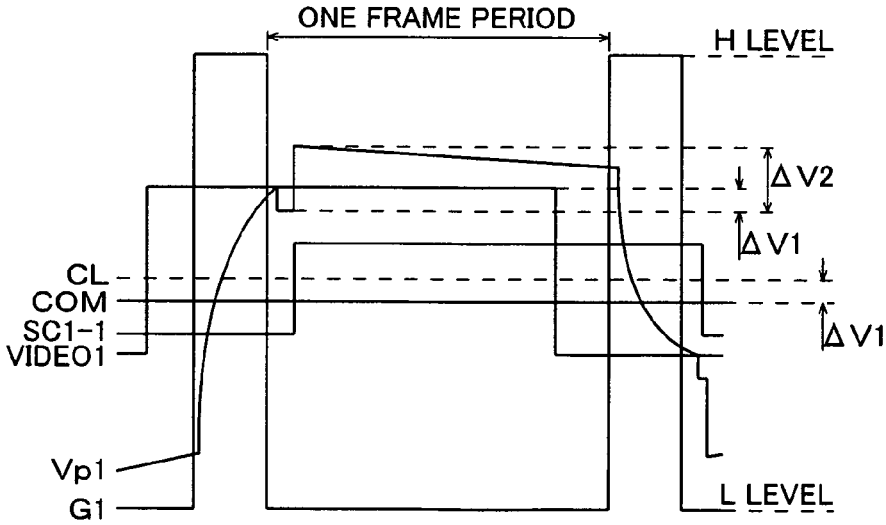
FIGS. 5 and 6 are waveform charts for explanation of operation in a pixel portion of the liquid crystal display according to the first embodiment shown in FIG. 1.

At this time, in the pixel portion 3*a*, when the n-channel transistor 32 turns to ON state, a video signal of H-level side is written to the pixel portion 3*a*. That is, as shown in FIG. 5, the pixel voltage supply source Vp1 goes up to the voltage supply source of the video signal line VIDEO. After that, when the signal provided to the gate line G1 becomes L level, the n-channel transistor 32 turns to OFF state. Thus, writing of video signal of H-level side to the pixel portion 3*a* is completed. At this time, a signal provided to the gate line G1 becomes L level. This drops the pixel voltage supply source Vp1 by ΔV1. Additionally, in consideration of the drop of ΔV1 of the pixel voltage supply source Vp1, the voltage supply source COM of the common electrode 35 is previously set to the voltage supply source that is ΔV1 lower than the center level CL of voltage supply source of the video signal line VIDEO1.

In this embodiment, after a signal provided to the gate line G1 becomes L level, the signal VSCH of H-level side is provided to the subsidiary capacitance line SC1-1. Thus, the signal VSCH of H-level side is provided to another electrode 37*a* of the subsidiary capacitance 33 (see FIG. 1), and the voltage supply source of the subsidiary capacitance 33 goes up to the H-level side. Accordingly, since electric charge is redistributed between the liquid crystal layer 31 and the subsidiary capacitance 33, the pixel voltage supply source Vp1 goes up by ΔV2 as shown in FIG. 5. The pixel voltage supply source Vp1 that goes up by ΔV2 is held during one frame period (period until which the n-channel transistor 32 turns to ON state again). In addition, the pixel voltage supply source Vp1 slightly varies with time due to influence such as a leak current.

Figure 6:
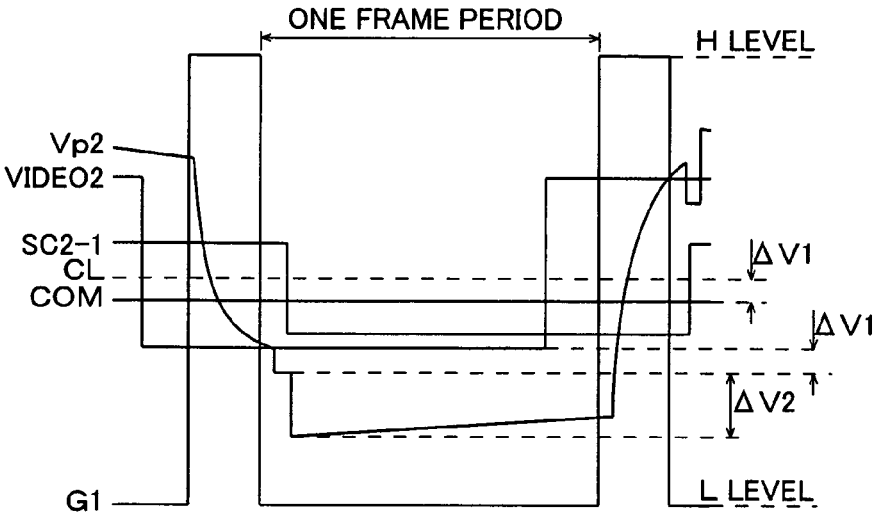

In the pixel portion 3*b* (see FIG. 1), when the n-channel transistor 32 turns to ON state, a video signal of L-level side is written to the pixel portion 3*b*. That is, as shown in FIG. 6, the pixel voltage supply source Vp2 drops to the voltage supply source of the video signal line VIDEO2. After that, when the signal provided to the gate line G1 becomes L level, the n-channel transistor 32 turns to OFF state. Accordingly, writing of video signal of L level to the pixel section 3*b* is completed, and the pixel voltage supply source Vp2 drops by ΔV1. After a signal provided to the gate line G1 becomes L level, the signal VSCL of L-level side is provided to the subsidiary capacitance line SC2-1. Thus, a signal of L-level side is provided to another electrode 37*b* of the subsidiary capacitance 33 (see FIG. 1), and the voltage supply source of the subsidiary capacitance 33 drops to the L-level side. Therefore, the pixel voltage supply source Vp2 drops by ΔV2, and the pixel voltage supply source Vp2 that drops by ΔV2 is held during one frame period.

The pixel portions arranged along the gate lines G2 to G5 of second stage and later (see FIG. 2) also sequentially operate similarly to the pixel portions 3*a* and 3*b* arranged along the gate line G1 of first stage. After operation of first frame is completed, a video signal provided to the video signal line VIDEO1 is inverted to the L-level side relative to the voltage supply source COM of the common electrode 35, and a video signal provided to the video signal line VIDEO2 is inverted to the H-level side relative to the voltage supply source COM of the common electrode 35.

Next, the clock signal CKVSC provided to the signal providing circuit 7 is switched to L level. In this case, as shown in FIG. 3, in the signal providing circuit portion 7*a*, since the clock signal CKVSC of L level is provided to the input terminal A of the clocked inverter 72*a*, the clock signal CKVSC is opposite to the case of H level. Thus, the switches 73*a* and 73*c* turn to OFF state, and the switches 73*b* and 73*d* turn to ON state. As a result, the signal VSCL of L-level side is provided to the subsidiary capacitance line SC1-1, and the signal VSCH of H-level side is provided to the subsidiary capacitance line SC2-1. In addition, the signal providing circuit portions 7*b* to 7*d* (see FIG. 2) also operate similarly to the signal providing circuit portion 7*a*.

Accordingly, in a second frame, the pixel portion 3*a* operates as shown in FIG. 6, and the pixel portion 3*b* operates as shown in FIG. 5. After a third frame, the video signal provided to the video signal line VIDEO1 is alternately switched to the H-level side and the L-level side, and the video signal provided to the video signal line VIDEO2 is alternately switched to the L-level side and the H-level side, for every one frame period. Alternately switching the clock signal CKVSC, which is provided to the signal providing circuit 7, to H level and L level performs switching so that one of the signal VSCH of H-level side and the signal VSCL of L-level side is alternatively provided to the subsidiary capacitance lines SC1-1 to 1-4, and the other of them is alternatively provided to the subsidiary capacitance lines SC2-1 to 2-4. As described above, the liquid crystal display according to the first embodiment is driven.

In the first embodiment, as mentioned above, the signal providing circuit 7, which includes the signal providing circuit portions 7*a*-7*d* for providing the signal VSCH of H-level side and the signal VSCL of L-level side, is provided for the subsidiary capacitance lines SC1-1 to SC1-4 of pixel portion 3*a*. Accordingly, the voltage supply source of the subsidiary capacitance 33 of the pixel portion can be set to an arbitrary level, for example. In addition, after writing of video signal to the pixel portion is completed, when a desired signal is provided to the electrode of the subsidiary capacitance 33 of pixel portion, the pixel voltage supply source of the pixel portion can be varied from the state right after writing of video signal is completed. Consequently, since it is not necessary to increase a voltage of video signal, power consumption can be reduced. Additionally, the pixel portions 3*a* and 3*b* are arranged adjacent to each other, thus, it is possible to easily perform dot inversion drive. Dissimilarly to line inversion drive, in this case, flicker does not appear in a line shape. As a result, flicker can be difficult to be observed.

Furthermore, in the first embodiment, the signal providing circuit portions 7*a* to 7*d* are provided so as to correspond to the gate lines G1 to G4, respectively. Accordingly, when video signals are sequentially written to the respective gate lines G1 to G5 of the pixel portions 3*a* and 3*b*, the respective signal providing circuit portions 7*a* to 7*d* can subsequently provide one and the other of the signal VSCH of H-level side and the signal VSCL of L-level side to the subsidiary capacitance lines SC1-1 to 1-4 and the subsidiary capacitance lines SC2-1 to 2-4 corresponding to the respective gate lines G1 to G4.

Moreover, in the first embodiment, switching is performed so that one of the signal VSCH of H-level side and the signal VSCL of L-level side is alternatively provided to the subsidiary capacitance lines SC1-1 to 1-4, and the other of them is alternatively provided to the subsidiary capacitance lines SC2-1 to 2-4, for every one frame period, thus, the voltage supply sources of video signals to be written to the pixel portions 3*a* and 3*b* are inverted relative to the voltage supply source COM of the common electrode 35 for every one frame period. Therefore, it is possible to perform dot inversion drive more easily. In this case, image persistence (image burn-in) can be easily kept in check.

Second Embodiment

Figure 7:
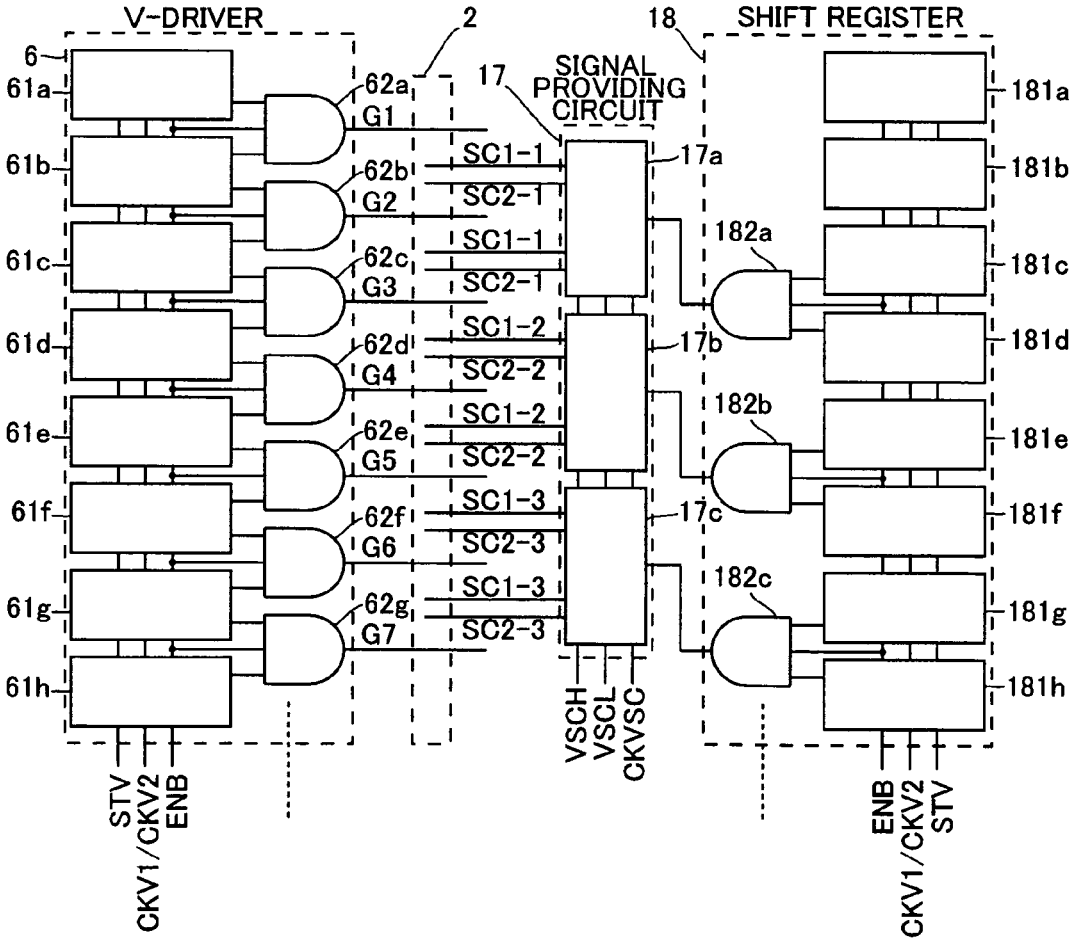
FIG. 7 is a block diagram showing a liquid crystal display according to a second embodiment.
Figure 8:
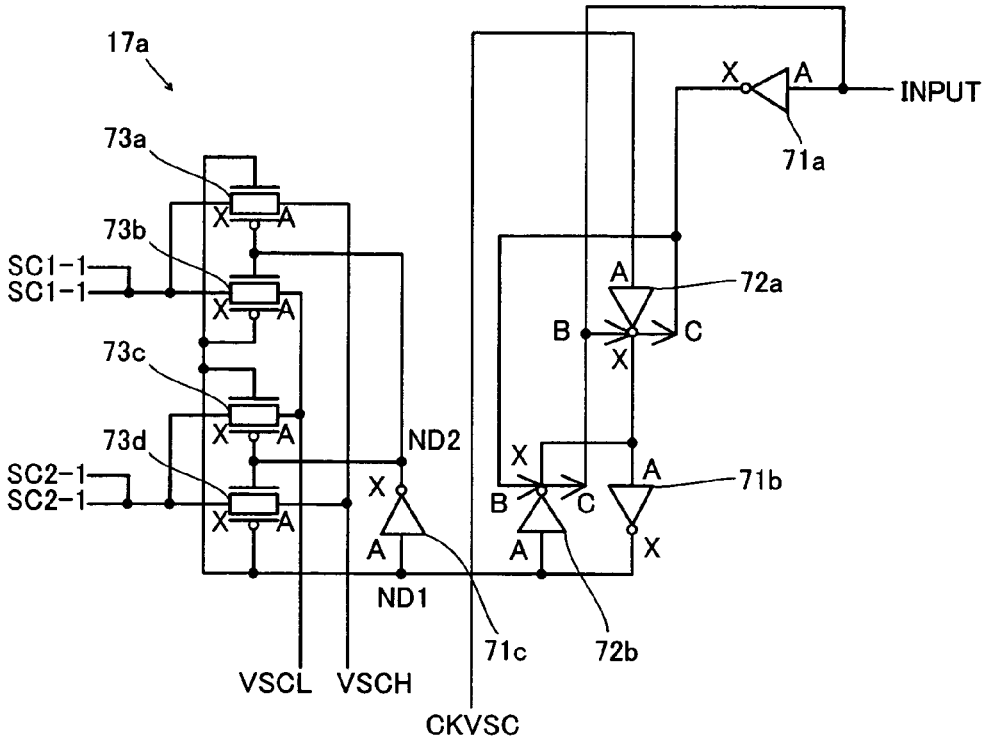
FIG. 8 is a circuit diagram showing a signal providing circuit portion of the liquid crystal display according to the second embodiment shown in FIG. 7.

With reference to FIGS. 7 and 8, in a second embodiment, dissimilarly to the-foregoing first embodiment, one signal providing circuit portion provided for every two stages of gate lines (2 lines) is described. The signal providing circuit portion simultaneously provides one and the other of a signal of H-level side and a signal of L-level side to two pairs of the subsidiary capacitance lines corresponding to two stages of gate lines, respectively.

In a liquid crystal display according to this second embodiment, as shown in FIG. 7, a V-driver 6 has circuit constitution similar to the foregoing first embodiment. However, it is noted that FIG. 7 shows seven AND circuit portions 62*a* to 62*g* and eight shift register circuit portions 61*a* to 61*h*.

In the second embodiment, the signal providing circuit 17 includes signal providing circuit portions 17*a* to 17*c*. Each of the signal providing circuit portions 17*a* to 17*c* is provided for every two stages of gate lines. Specifically, signal providing circuit portions 17*a*, 17*b* and 17*c* are provided so as to correspond to pairs of gate lines G1 and G2, G3 and G4, and G5 and G6, respectively. The signal providing circuit portion corresponding to the gate line G7 is not shown for ease of illustration.

In the circuit constitution of the signal providing circuit portion 17*a*, specifically, as shown in FIG. 8, the output terminals X of the switches 73*a* and 73*b* are connected to two stages of subsidiary capacitance lines SC1-1, and the output terminals-X of the switches 73*c* and 73*d* are connected to two stages of subsidiary capacitance lines SC2-1. The circuit constitution of the other part of the signal providing circuit portion 17*a* is similar to the signal providing circuit portion 7*a* of the first embodiment shown in FIG. 3. In addition., the signal providing circuit portions 17*b* and 17*c* shown in FIG. 7 have circuit constitution similar to the signal providing circuit portion 17*a* except the subsidiary capacitance lines connected thereto.

As shown in FIG. 7, the shift register 18 includes shift register circuit portions 181*a* to 181*h*. The shift register 18 is an example of the "second shift register" in the present invention. These shift register circuit portions 181*a* to 181*h* have circuit constitution similar to the shift register circuit portions 61*a* to 61*h* of the V-driver 6, respectively. In addition, the shift register 18 includes AND circuit portions 182*a* to 182*c*, each of which has three input terminals and one output terminal.

Output signals of the shift register circuit portions 181*c* and 181*d*, and the enable signal ENB are provided to the input terminals of the AND circuit portion 182*a*. Output signals of the shift register circuit portions 181*e* and 181*f*, and the enable signal ENB are provided to the input terminals of the AND circuit portion 182*b*. Output signals of the shift register circuit portions 181*g* and 181*h*, and the enable signal ENB are provided to the input terminals of the AND circuit portion 182*c*. The output terminals of the AND circuit portions 182*a* to 182*c* are connected to the signal providing circuit portions 17*a* to 17*c*, respectively. In addition, the shift register 18 is not provided with AND circuit portions, to which output signals of the shift register circuit portions 181*a* and 181*b* and the shift register circuit portions 181*b* and 181*c* are provided, dissimilarly to the V-driver 6. In addition, AND circuit portions, to which output signals of the shift register circuit portions 181*d* and 181*e* and the shift register circuit portions 181*f* and 181*g* are provided, are not provided. The reason is that, since the same start signal STV, clock signal CKV, and enable signal ENB as the V-driver 6 are provided to the shift register 18, such an AND circuit portion of first stage, to which the output signal of the shift register circuit portions 181*a* and 181*b* are provided, is not necessary, similarly to the foregoing first embodiment. Additionally, in this second embodiment, since subsidiary capacitance lines corresponding to two stages are connected to one signal providing circuit portion, only one AND circuit portion is also connected for subsidiary capacitance lines corresponding to each two stages. Accordingly, AND circuit portions, to which the output signals of the shift register circuit portions 181*b* and 181*c*, the shift register circuit portions 181*d* and 181*e*, and the shift register circuit portions 181*f* and 181*g* are provided, is not necessary.

The operation of the display according to the second embodiment is now described with reference to FIGS. 7 to 9. Description of parts similar to the first embodiment is omitted.

Figure 9:
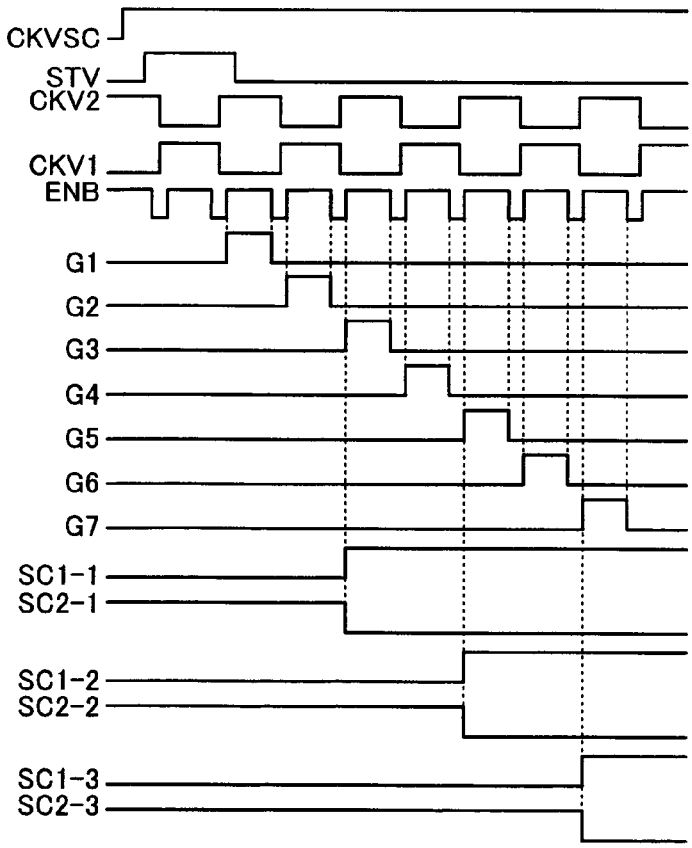
FIG. 9 is a timing chart for explanation of operation in a V-driver, the signal providing circuit and a shift register of the liquid crystal display according to the second embodiment shown in FIG. 7.

First, as shown in FIG. 9, the start signal STV of H level is provided to the V-driver 6 and shift register 18 shown in FIG. 7. Next, the V-driver 6 operates similarly to the V-driver 6 of the first embodiment shown in FIG. 2. That is, after signals of H level are sequentially provided to the gate lines G1 to G7, signals of L level are sequentially provided to the gate lines G1 to G7. The signals of L level sequentially provided to the gate lines G1-G7 are held at L level during one frame period.

In the shift register 18 (see FIG. 7), when the clock signal CKV1 becomes H level, the shift register circuit portion 181*a* is driven. Then, the clock signal CKV1 becomes L level. After that, when the clock signal CKV2 becomes H level, the shift register circuit portion 181*b* is driven. Then, the clock signal CKV2 becomes L level.

Next, when the clock signal CKV1 becomes H level again, a signal of H level is provided from the shift register circuit portion 181*c* to the AND circuit portion 182*a*. After that, when the clock signal CKV1 becomes L level, and the clock signal CKV2 becomes H level again, a signal of H level is provided from the shift register circuit portion 181*d* to the AND circuit portion 182*a*. Subsequently, when the enable signal ENB becomes H level, a signal of H level is provided from the AND circuit portion 182*a*. After that, the enable signal ENB becomes L level, thus, a signal of L level is provided from the AND circuit portion 182*a*, and the signal of L level is held at L level during one frame period. Then, the clock signal CKV2 becomes L level.

Similarly, when the clock signal CKV1 becomes H level again, a signal of H level is provided from the shift register circuit portion 181*e* to the AND circuit portion 182*b*. Then, when the clock signal CKV2 becomes H level again, a signal of H level is provided from the shift register circuit portion 181*f* to the AND circuit portion 182*b*. Subsequently, when the enable signal ENB becomes H level, a signal of H level is provided from the AND circuit portion 182*b*. After that, the enable signal ENB becomes L level, thus, a signal of L level is provided from the AND circuit portion 182*b*, and the signal of L level is held at L level during one frame period. Then, the clock signal CKV2 becomes L level.

After that, similarly to the aforementioned AND circuit portions 182*a* and 182*b*, signals of H level from the shift register circuit portions 181*g* and 181*h* are provided to the AND circuit portion 182*c* in synchronization with the clock signals CKV1 and CKV2, and a signal of H level is provided from the AND circuit portion 182*c* in synchronization with the enable signal ENB. Accordingly, signals of H level are sequentially provided from the shift register 18 for every two stages of gate lines. In addition, in signals of H level provided from the shift register 18, the signals provided from the AND circuit portions 182*a* to 182*c* are provided with timing similar to providing signals of H level to the gate lines G3, G5 and G7.

Signals of H level sequentially provided from the shift register 18 are sequentially provided to the signal providing circuit portions 17*a* to 17*c* of the signal providing circuit 17 (see FIG. 7). The signal providing circuit portion 17*a* operates similarly to the signal providing circuit portion 7*a* according to the first embodiment shown in FIG. 3. That is, as shown in FIG. 8, the switches 73*a* and 73*c* turn to the ON state, and the switches 73*b* and 73*d* turn to the OFF state, thus, the signal VSCH of H-level side and the signal VSCL of L-level side are provided to the subsidiary capacitance lines SC1-1 and SC2-1, respectively. In addition, the signal providing circuit portions 17*b* to 17*d* shown in FIG. 7 operate similarly to the signal providing circuit portion 17*a*.

Accordingly, the signal VSCH of H-level side and the signal VSCL of L-level side from the signal providing circuit portions 17*a* to 17*c* are sequentially provided to the subsidiary capacitance lines SC1-1 to SC1-3 and the subsidiary capacitance lines SC2-1 to SC2-3 corresponding to two stages, respectively, with timing similar to providing signals of H level to the gate lines G3, G5 and G7.

In addition, operation performed in the display portion (not shown) of the second embodiment is similar to the foregoing first embodiment.

In the second embodiment, as mentioned above, the signal providing circuit portions 17*a* to 17*c* are provided so as to correspond to two stages of the gate lines G1 and G2 (2 lines), two stages of the gate lines G3 and G4, and two stages of the gate lines G5 and G6, respectively. Accordingly, the number of signal providing circuit portions can be reduced as compared with the case where one signal providing circuit portion is provided so as to correspond to each of a plurality of stages of gate lines (a plurality of lines). Therefore, it is possible to reduce a circuit scale and to improve yield.

In addition, the other effects in the second embodiment are similar to the foregoing first embodiment.

Third Embodiment

Figure 10:
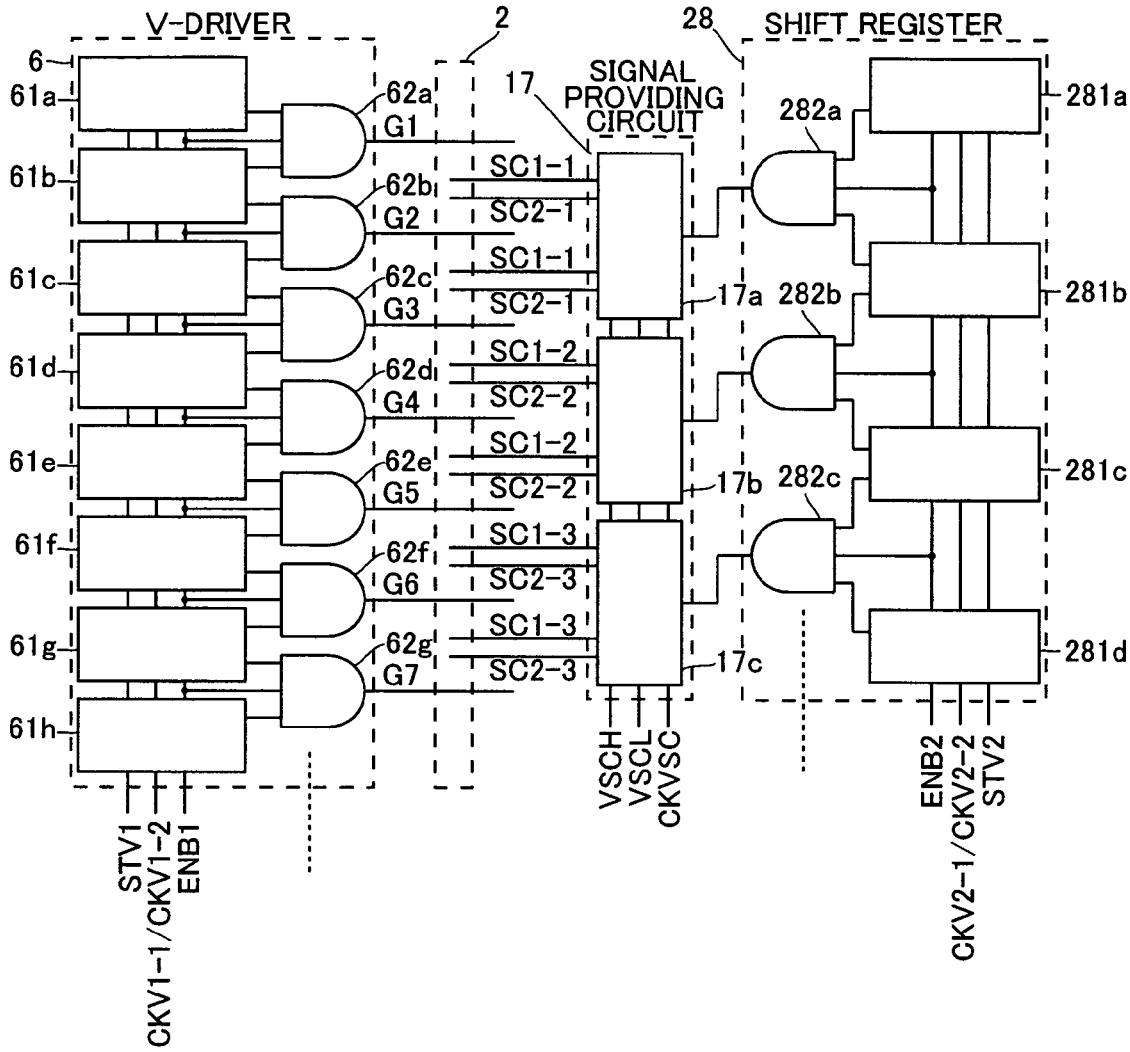
FIG. 10 is a block diagram showing a liquid crystal display according to a third embodiment.

With reference to FIG. 10, dissimilarly to the foregoing first and second embodiments, in a third embodiment, the case where the period of pulse signal for driving a shift register is double the period of pulse signal for driving a V-driver is described.

In a liquid crystal display according to this third embodiment, as shown in FIG. 10, a V-driver 6 and a signal providing circuit 17 have circuit constitution similar to the foregoing second embodiment. The periods of start signal STV1, clock signal CKV1-1/CKV1-2, and enable signal ENB1 for driving the V-driver 6 are similar to those of start signal STV, clock signal CKV, and enable signal ENB of the foregoing second embodiment.

In the third embodiment, a shift register 28 includes four shift register circuit portions 281*a* to 281*d*. That is, the number of the shift register circuit portions (281*a* to 281*d*), which constitute the shift register 28, is half the number of shift register circuit portions (61*a* to 61*h*), which constitute the V-driver 6. The shift register 28 is an example of the "second shift register" in the present invention. These shift register circuit portions 281*a* to 281*d* have circuit constitution similar to the shift register circuit portions 61*a* to 61*d* of the V-driver 6, respectively. In addition, the shift register 28 includes AND circuit portions 282*a* to 282*c*, each of which has three input terminals and one output terminal.

Output signals of the shift register circuit portions 281*a* and 281*b*, and an enable signal ENB2 are provided to the input terminals of the AND circuit portion 282*a*. Output signals of the shift register circuit portions 281*b* and 281*c*, and the enable signal ENB2 are provided to the input terminals of the AND circuit portion 282*b*. Output signals of the shift register circuit portions 281*c* and 281*d*, and the enable signal ENB2 are provided to the input terminals of the AND circuit portion 282*c*. The output terminals of the AND circuit portions 282*a* to 282*c* are connected to the signal providing circuit portions 17*a* to 17*c*, respectively. The periods of start signal STV2, clock signal CKV2-1/2-2, and enable signal ENB2 for driving the shift register 28 is double the periods of start signal STV1, clock signal CKV1-1/1-2, and the enable signal ENB1 for the driving V-driver 6.

The operation of the display according to the third embodiment is now described with reference to FIGS. 10 and 11.

Figure 11:
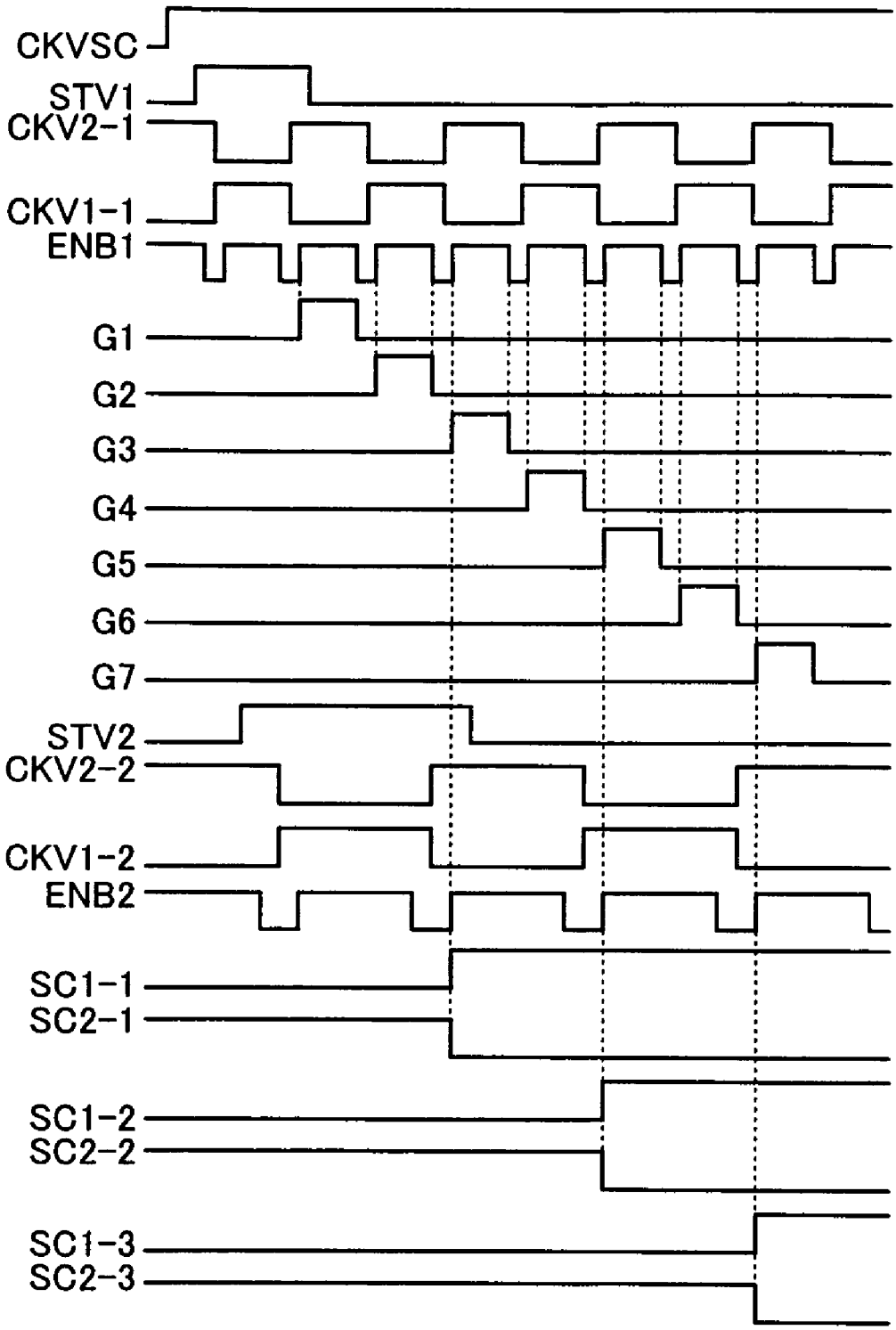
FIG. 11 is a timing chart for explanation of operation in a V-driver, the signal providing circuit and a shift register of the liquid crystal display according to the third embodiment shown in FIG. 10.

First, as shown in FIG. 11, the start signals STV1 and STV2 of H level are provided to the V-driver 6 and shift register 28 shown in FIG. 10, respectively. Next, the V-driver 6 operates similarly to the V-driver 6 of the first embodiment shown in FIG. 2. That is, after signals of H level are sequentially provided to the gate lines G1 to G7, signals of L level are sequentially provided thereto, and are held at L level during one frame period.

In the shift register 28 (see FIG. 10), when the clock signal CKV2-1 becomes H level, a signal of H level is provided from the shift register circuit portion 281*a* to the AND circuit portion 282*a*. Then, the clock signal CKV2-1 becomes L level. Next, when the clock signal CKV2-2 becomes H level, signals of H level are provided from the shift register circuit portion 281*b* to the AND circuit portions 282*a* and 282*b*. Subsequently, when the enable signal ENB2 becomes H level, a signal of H level is provided from the AND circuit portion 282*a*. After that, the enable signal ENB2 becomes L level, thus, a signal of L level is provided from the AND circuit portion 282*a*, and the signal of L level is held at L level during one frame period. Then, the clock signal CKV2-2 becomes L level.

Next, signals of H level are provided from the AND circuit portions 282*b* and 282*c* in synchronization with the clock signals CKV2-1 and CKV2-2 similarly to the aforementioned AND circuit portion 282*a*. Accordingly, signals of H level are sequentially provided from the shift register 28. In addition, in signals of H level provided from the shift register 28, the signals provided from the AND circuit portions 282*a* to 282*c* are provided with timing similar to providing signals of H level to the gate lines G3, G5 and G7.

Signals of H level sequentially provided from the shift register 28 are sequentially provided to the signal providing circuit portions 17*a* to 17*c* of the signal providing circuit 17 (see FIG. 10). The signal providing circuit portion 17*a* operates similarly to the signal providing circuit portion 17*a* according to the second embodiment shown in FIG. 8. That is, the switches 73*a* and 73*c* turn to ON state, and the switches 73*b* and 73*d* turn to OFF state, thus, the signal VSCH of H-level side and the signal VSCL of L-level side are provided to the subsidiary capacitance lines SC1-1 and SC2-1, respectively. In addition, the signal providing circuit portions 17*b* to 17*d* shown in FIG. 10 operate similarly to the signal providing circuit portion 17*a*.

Accordingly, similarly to the foregoing second embodiment, the signal VSCH of H-level side and the signal VSCL of L-level side from the signal providing circuit portions 17*a* to 17*c* are sequentially provided to the subsidiary capacitance lines SC1-1 to SC1-3 and the subsidiary capacitance lines SC2-1 to SC2-3 corresponding to two stages, respectively, with timing similar to providing signals of H level to the gate lines G3, G5 and G7.

In addition, operation performed in the display portion (not shown) of the third embodiment is similar to the foregoing first embodiment.

In the third embodiment, as mentioned above, the periods of start signal STV2, clock signal CKV2-1/2-2, and enable signal ENB2 for driving the shift register 28 is double the periods of start signal STV1, clock signal CKV1-1/1-2, and enable signal ENB1 for the driving V-driver 6. Thus, the number of the shift register circuit portions (281*a* to 281*d*), which constitute the shift register 28, can be reduced to half the number of the shift register circuit portions (61*a* to 61*h*), which constitute the V-driver 6. Accordingly, the number of the shift register circuit portions can be reduced as compared with the foregoing second embodiment. Therefore, it is possible to reduce a circuit scale and to improve yield.

In addition, the other effects in the third embodiment are similar to the foregoing first embodiment.

Fourth Embodiment

Figure 12:
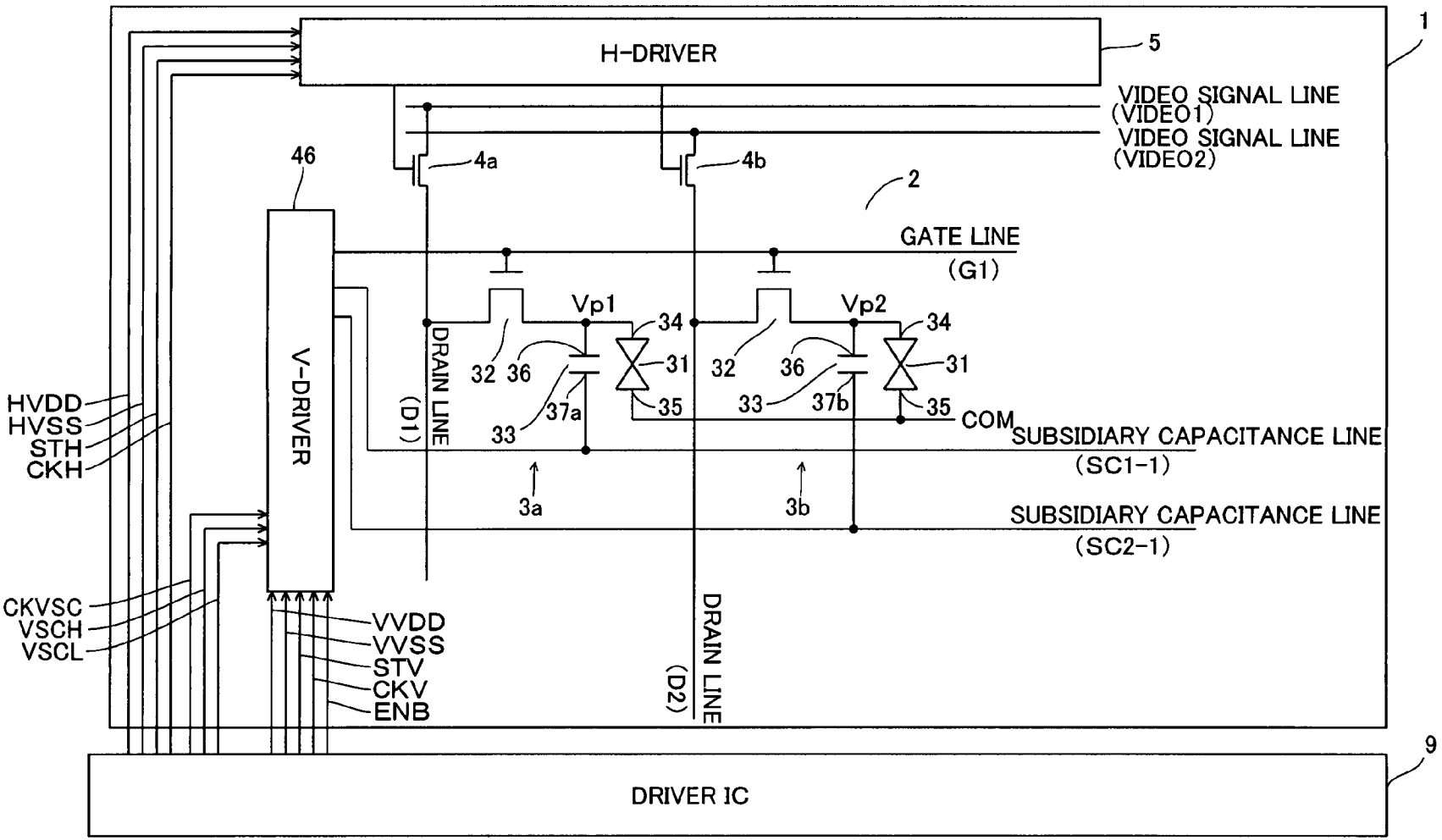
FIG. 12 is a plan view showing a liquid crystal display according to a fourth embodiment.
Figure 13:
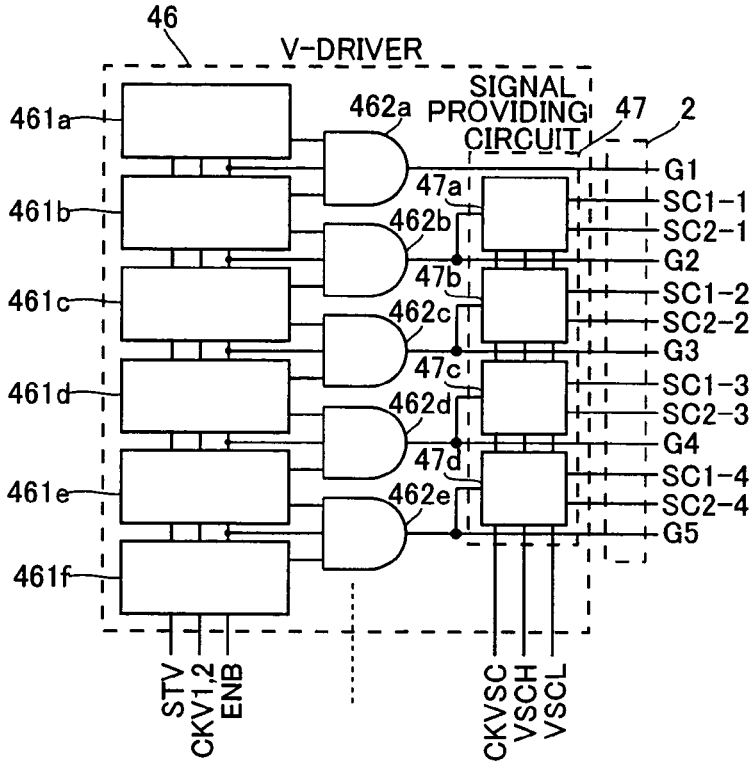
FIG. 13 is a block diagram showing the liquid crystal display according to the fourth embodiment shown in FIG. 12.
Figure 14:
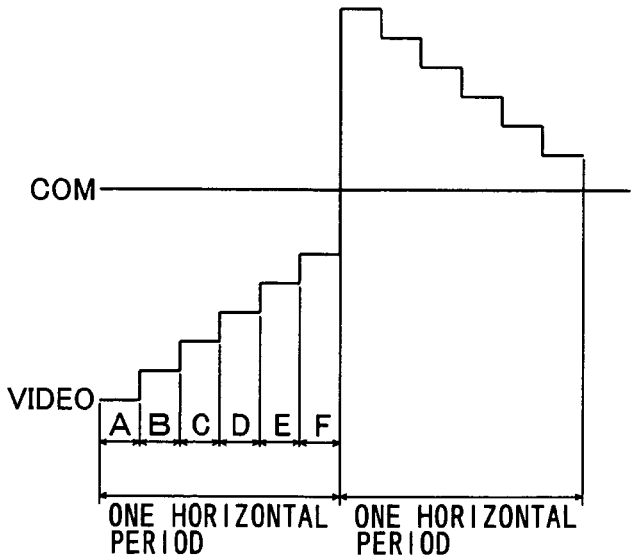
FIG.14 PRIOR ART
FIG. 14 is a waveform chart in the case where a liquid crystal display is driven by a conventional line inversion drive method.
Figure 15:
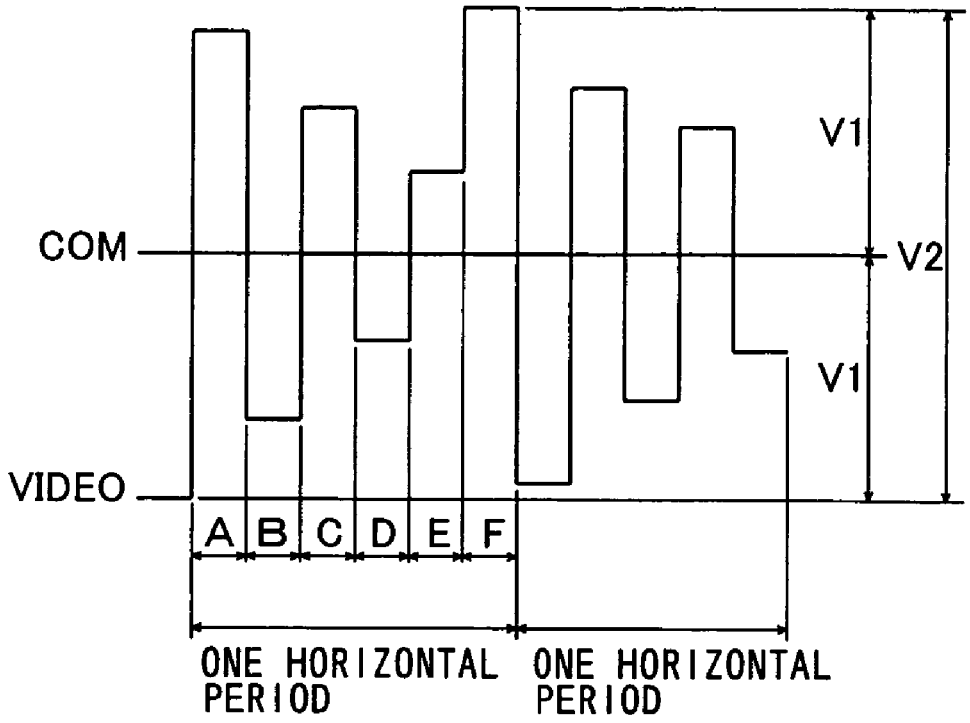
FIG.15 PRIOR ART
FIG. 15 is a waveform chart in the case where a liquid crystal display is driven by a conventional dot inversion drive method.

With reference to FIGS. 12 and 13, dissimilarly to the foregoing first to third embodiments, in a fourth embodiment, the case where a signal providing circuit is installed in a V-driver, and the signal providing circuit is driven by using a signal for driving (scanning) gate lines is described.

In this fourth embodiment, as shown in FIG. 12, a V-driver 46 with a signal providing circuit 47 installed therein (see FIG. 13) is provided on a circuit board 1. Both the subsidiary capacitance line SC1-1 corresponding to the pixel portion 3*a* and the subsidiary capacitance line SC2-1 corresponding to the pixel portion 3*b* are connected to the signal providing circuit 47 installed in the V-driver 46. The V-driver 46 is an example of the "gate line drive circuit" and "shift register" in the present invention. In addition, the other constitution in the fourth embodiment is similar to the foregoing first embodiment.

With reference to FIG. 13, the internal constitution of V-driver 46 is now described. The V-driver 46 includes shift register circuit portions 461*a* to 461*f*. In addition, the V-driver 46 includes AND circuit portions 462*a* to 462*e*, each of which has three input terminals and one output terminal.

Output signals of the shift register circuit portions 461*a* and 461*b*, and the enable signal ENB are provided to the input terminals of the AND circuit portion 462*a*. In the AND circuit portion 462*b* or later, output signals of the shift register circuit portions of two stages that are shifted one stage each are similarly provided thereto. The output terminals of the AND circuit portions 462*a* to 462*e* are connected to the gate lines G1 to G5, respectively.

In the fourth embodiment, as described above, the signal providing circuit 47 is installed in the V-driver 46. The signal providing circuit 47 includes signal providing circuit portions 47*a* to 47*d*. The signal providing circuit portions 47*a* to 47*d* are provided so as to correspond to the gate lines G1 to G4, respectively. The signal providing circuit portion corresponding to the gate line G5 is not shown for ease of illustration.

The circuit constitution of the signal providing circuit portion 47*a* is similar to the signal providing circuit portion 7*a* of the first embodiment shown in FIG. 3. In this fourth embodiment, however, as shown in FIG. 13, the signal providing circuit portion 47*a* corresponding to the gate line G1 is provided with an output signal of the AND circuit portion 462*b* whose output terminal is connected to the gate line G2. That is, in this fourth embodiment, the signal providing circuit portion connected to the subsidiary capacitance line corresponding to the gate line of a prescribed stage is provided with an output signal of the AND circuit portion whose output terminal is connected to the gate line of the subsequent stage. The signal providing circuit portions 47*b* to 47*d* have circuit constitution similar to the signal providing circuit portion 47*a*.

In this fourth embodiment, the V-driver 46 with the signal providing circuit 47 installed therein is driven with a timing chart similar to that of V-driver 6, signal providing circuit 7 and shift register 8 of the first embodiment shown in FIG. 4. However, dissimilarly to the foregoing first embodiment, in this fourth embodiment, signals of H level from the AND circuit portions 462*b* to 462*e*, which provide signals to the gate lines of second stage and later, are sequentially provided to the signal providing circuit portions 47*a* to 47*d*. Accordingly, the signal providing circuit portions 47*a* to 47*d* operate similarly to the signal providing circuit portion 7*a* of the foregoing first embodiment.

In the fourth embodiment, as mentioned above, the signal providing circuit 47 is installed in the V-driver 46, and the signal providing circuit portions 47*a* to 47*d* are sequentially driven by using signals for sequentially driving the gate lines G2 to G5. A shift register for sequentially driving the signal providing circuit portions 47*a* to 47*d* is not necessary to be provided separately from the V-driver 46 for sequentially driving the gate lines G1 to G5. Therefore, it is possible to further reduce a circuit scale and to further improve yield as compared with the foregoing third embodiment.

In this fourth embodiment, the signal providing circuit portion corresponding to the gate line of a prescribed stage is provided with an output signal of the AND circuit portion whose output terminal is connected to the gate line of the subsequent stage, thus, the signal providing circuit portion corresponding to the gate line of the prescribed stage is driven. Accordingly, an output signal from the shift register circuit portion of the stage subsequent to the prescribed stage is provided after an output signal of the shift register circuit portion for driving the gate line of the prescribed stage is provided. Therefore, one and the other of the signal VSCH of H-level side and the signal VSCL of L-level side can be provided to one pair of the subsidiary capacitance lines, respectively, after writing of video signals to the pixel portions arranged along the gate line of the prescribed stage is completed.

It should be appreciated, however, that the embodiments described above are illustrative, and the invention is not specifically limited to description above. The invention is defined not by the foregoing description of the embodiments, but by the appended claims, their equivalents, and various modifications that can be made without departing from the scope of the invention as defined in the appended claims.

For example, in the foregoing first to fourth embodiments, the signal providing circuit portions have circuit constitution shown in FIG. 3 or 8, however, the present invention is not limited to the circuit constitution as long as one and the other of the signal VSCH of H-level side and the signal VSCL of L-level side can be provided to at least one pair of the subsidiary capacitance lines, respectively. In addition, the present invention is not limited as long as one of the signal VSCH of H-level side and the signal VSCL of L-level side can be alternatively provided to one of a pair of the subsidiary capacitance lines or one group of pairs of the subsidiary capacitance lines, and the other of them can be alternatively provided to another of the pair of the subsidiary capacitance lines or the other group of the pairs of the subsidiary capacitance lines, for every one frame period.

In each of the foregoing first to fourth embodiments, the pixel portions 3*a* and 3*b* are arranged adjacent to each other whereby achieving dot inversion drive. However, the present invention is not limited to this arrangement. One block may include only a plurality of pixel portions 3*a*, another block may include only a plurality of pixel portions 3*b*, and the one, and another blocks may be arranged adjacent to each other, whereby achieving block inversion drive.

In each of the foregoing first to fourth embodiments, the n-channel transistors for driving the drain lines sequentially turn to ON state, however, the present invention is not limited to this. All the n-channel transistors for the driving drain lines may simultaneously turn to ON state.

In each of the foregoing first to third embodiments, a plurality of the signal providing circuit portions are sequentially driven by using the shift register including the shift register circuit portions, which have circuit constitution similar to the shift register circuit portions of the V-driver. However, the present invention is not limited to this constitution. A shift register including shift register circuit portions, which have circuit constitution dissimilar to the shift register circuit portions of the V-driver, may be used as long as a plurality of signal providing circuit portions can be sequentially driven.

In each of the foregoing first to third embodiments, one and the other of the signal VSCH of H-level side and the signal VSCL of L-level side are provided to at least one pair of the subsidiary capacitance lines corresponding to the gate lines of a prescribed stage, respectively, with timing similar to writing of video signals to the pixel portions arranged along the gate line subsequent to the prescribed stage. However, the present invention is not limited to this timing. Timing of providing a prescribed signal to at least one pair of the subsidiary capacitance lines corresponding to the gate lines of a prescribed stage may not be same as timing of writing of video signals to the pixel portions arranged along the gate line of the subsequent stage.

In each of the foregoing second and third embodiments, one signal providing circuit portion is provided for every two stages of the gate lines, however, the present invention is not limited to this. One signal providing circuit portion may be provided for every three or more stages of the gate lines.

What is claimed is:

1. A display comprising:

a plurality of drain and gate lines which are arranged so as to intersect each other;

first and second pixel portions, each of which includes subsidiary capacitances having a first electrode which is connected to a pixel electrode and a second electrode, arranged adjacent to each other along the same gate line;

a first subsidiary capacitance line which is connected to said second electrode of said subsidiary capacitance of said first pixel portion and a second subsidiary capacitance line which is connected to said second electrode of said subsidiary capacitance of said second pixel portion, the first and second subsidiary capacitance lines being provided corresponding to one of the plurality of gate lines; and a signal providing circuit including a plurality of signal providing circuit portions which provide a first signal with a first voltage supply source and a second signal with a second voltage supply source to the first subsidiary capacitance line of said first pixel portion and the second subsidiary capacitance line of said second pixel portion, respectively, wherein one of said signal providing circuit portions is provided to every one of said plurality of gate lines or every two or more of said plurality of gate lines, and respective said signal providing circuit portions provide said first and second signals to said first and second subsidiary capacitance lines of said gate lines corresponding thereto, respectively, and said first signal is provided to said first subsidiary capacitance line and said second signal is provided to said second subsidiary capacitance line in one frame period, and said second signal is provided to said first subsidiary capacitance line and said first signal is provided to said second subsidiary capacitance line in the next one frame period.

2. The display according to claim 1, wherein the one of said signal providing circuit portions is provided to every one of said plurality of gate lines corresponding thereto, and respective said signal providing circuit portions sequentially provide said first and second signals to said first and second subsidiary capacitance lines of said gate lines corresponding thereto, respectively.

3. The display according to claim 1, wherein one of said signal providing circuit portions is provided to every two or more of said plurality of gate lines, and said signal providing circuit portion simultaneously provides said first and second signals to said first and second subsidiary capacitance lines of said two or more of gate lines corresponding thereto, respectively.

4. The display according to claim 3, wherein one of said-signal providing circuit portions is provided to every two of the gate lines.

5. The display according to claim 1, wherein the display further comprises a gate line drive circuit including a first shift register which sequentially drives said plurality of gate lines, and a second shift register which is provided separately from the gate line drive circuit including said first shift register and sequentially drives said plurality of signal providing circuit portion.

6. The display according to claim 5, wherein said second shift register includes a plurality of shift register circuit portions, and said signal providing circuit portion of a prescribed stage provides said first and second signals in response to an output signal of said shift register circuit portion of the stage subsequent to said prescribed stage or later.

7. The display according to claim 6, wherein said second shift register is driven based on the same pulse signal as a pulse signal for driving said first shift register.

8. The display according to claim 5, wherein said second shift register is driven based on a second pulse signal that has double the period of a first pulse signal driving said first shift register.

9. The display according to claim 8, wherein said first and second shift registers include a plurality of first and second shift register circuit portions, respectively, and the number of said second shift register circuit portions is half the number of said first shift register circuit portions.

10. The display according to claim 1, wherein the display further comprises a gate line drive circuit including a shift register which sequentially drives said plurality of gate lines; and said plurality of signal providing circuit portions are sequentially driven by the shift register of said gate line drive circuit.

11. The display according to claim 10, wherein the shift register of said gate line drive circuit includes a plurality of shift register circuit portions, and said signal providing circuit portion of a prescribed stage provides said first and second signals in response to an output signal of said shift register circuit portion of the stage subsequent to said prescribed stage or later.

12. The display according to claim 10, wherein said plurality of signal providing circuit portions are installed in said gate line drive circuit.

13. The display according to claim 1, wherein said signal providing circuit portion provides said first and second signals to said first and second subsidiary capacitance lines, respectively, after writing of video signals to all the pixel portions arranged along at least one gate line is completed.

14. The display according to claim 13, wherein said signal providing circuit portion alternatively provides one of said first and second signals to said first subsidiary capacitance line, and the other of said first and second signals to said second subsidiary capacitance line for each one frame period where writing of signals to all the pixel portions is completed.

15. The display according to claim 13, wherein said signal providing circuit portion provides said first and second signals to said first and second subsidiary capacitance lines, respectively, after writing of said video signals to all the pixel portions arranged along two gate lines is completed.

16. The display according to claim 13, wherein said signal providing circuit portion provides said first and second signals to said first and second subsidiary capacitance lines, respectively, until at least one frame period where writing of video signals to all the pixel portions arranged is completed is finished.

17. The display according to claim 1, wherein video signals which are provided to the first electrode of said first and second pixel portions have waveforms that are inverted from each other.

18. The display according to claim 1, wherein a first block constituted of only said plurality of first pixel portions and a second block constituted of only said plurality of second pixel portions are arranged adjacent to each other, and video signals, which are provided to said plurality of first pixel portions constituting said first block and said plurality of second pixel portions constituting said second block, have waveforms that are inverted from each other.

19. The display according to claim 1, wherein said first and second pixel portions include liquid crystals.

* * * * *